US007256742B2

(12) United States Patent
Chen et al.

(10) Patent No.: US 7,256,742 B2
(45) Date of Patent: Aug. 14, 2007

(54) FLEXIBLE ANTENNA APPARATUS AND A MANUFACTURING METHOD THEREOF

(75) Inventors: Bin-Hung Chen, Hsinchu (TW); Chih-Ming Chen, Hsinchu (TW)

(73) Assignee: Inpaq Technology Co., Ltd., Hsinchu (TW)

( * ) Notice: Subject to any disclaimer, the term of this patent is extended or adjusted under 35 U.S.C. 154(b) by 58 days.

(21) Appl. No.: 11/199,079

(22) Filed: Aug. 9, 2005

(65) Prior Publication Data

US 2007/0035447 A1 Feb. 15, 2007

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/700 MS, 343/702, 713

See application file for complete search history.

(56) References Cited

U.S. PATENT DOCUMENTS 5,841,403 A * 11/1998 West ..... 343/702
6,002,373 A * 12/1999 Taniguchi et al. ..... 343/713
6,061,028 A * 5/2000 Sakata ..... 343/702

* cited by examiner

*Primary Examiner*—Hoang V. Nguyen
(74) *Attorney, Agent, or Firm*—Rosenberg, Klein & Lee

(57) ABSTRACT

A flexible antenna apparatus and a manufacturing method thereof are provided for wireless communication devices. The flexible antenna has a metal layer with an adhesive layer pasted onto the back surface of the metal layer, so that it can be directly pasted onto the housing of the wireless communication device. On another side of the metal layer, there is a transparent protective layer and the metal layer reserves a zone without the transparent protective layer for electrically coupling to the electrical substrate of the wireless communication device. The present flexible antenna apparatus reduces the developing time and cost of the device and the manufacturing process more convenient. The flexible antenna apparatus is suitable for all wireless communication devices and increases the flexibility of the manufacturing process by adding a holder having at least one plastic pin, or a pin.

13 Claims, 3 Drawing Sheets

FLEXIBLE ANTENNA APPARATUS AND A MANUFACTURING METHOD THEREOF

BACKGROUND OF THE INVENTION

1. Field of the Invention

The present invention relates to a flexible antenna apparatus and a manufacturing method thereof. In particular, this invention provides an antenna for wireless communication devices.

2. Description of the Related Art

Due to the development of wireless communication technology, wireless communication devices, such as Bluetooth systems, mobile phones etc are becoming more and more popular. Because customers desire wireless communication devices that are small, lightweight and have good reception many improvements for the antennas of wireless communication devices have been provided. The types of antennas for wireless communication devices can be divided into two sorts: a built-in type and an external type. The external type exposes the antenna to the outside of the housing of a wireless communication device. Because the wireless communication device has a protruding element, it is inconvenient for users to carry around. Alternatively, the built-in type installs a flat antenna in the housing of a wireless communication device to receive signals.

A built-in antenna of the prior art is shown in FIG. 1. The antenna includes a body 10 that is made of phosphor bronze. The body 10 has a plurality of positioning holes 12, a curved surface 14 that is pasted onto the housing of the mobile phone and a pin 16 for contacting the PCB of the mobile phone. When the antenna is pasted onto the housing of the wireless communication device, the positioning holes 12 are aligned to the positioning point of the housing and fix the built-in antenna onto the housing by a melting and pressing method.

The built-in antenna described above is produced through a stamping process. A mold is needed for the stamping process and the mold needs to be modified in order to make the antenna paste onto the curved-surface of the housing smoothly. It takes a long time to make the mold. The raw material for the antenna is only suitable for a single type of mobile phone, so there is the problem of surplus material that is wasted. The cost of the antenna is high due to the need of developing the mold. Furthermore, the manufacturing process is complex because the melting and pressing process needs to be added the production line of the wireless communication device.

SUMMARY OF THE INVENTION

One particular aspect of the present invention is to provide a flexible antenna apparatus and a manufacturing method thereof. The flexible antenna has a metal layer with an adhesive layer pasted on the back surface of the metal layer, so that it can be directly pasted onto the housing of the wireless communication device. On another side of the metal layer, there is a transparent protective layer and the metal layer reserves a zone without the transparent protective layer for electrically coupling to the electrical substrate of the wireless communication device. The present invention reduces the developing time and cost of the manufacturing process. Thereby the manufacturing process is more convenient.

Another particular aspect of the present invention provides a flexible antenna apparatus and a manufacturing method thereof. The flexible antenna has a metal layer with an adhesive layer pasted onto the back surface of the metal layer. On another side of the metal layer, there is a transparent protective layer and the metal layer reserves a zone without the transparent protective layer. The antenna is pasted onto a holder having a plastic pin for electrically coupling to the electrical substrate of the wireless communication device.

A further particular aspect of the present invention provides a flexible antenna apparatus and a manufacturing method thereof. The flexible antenna has a metal layer with an adhesive layer pasted on the back surface of the metal layer. On another side of the metal layer, there is a transparent protective layer and the metal layer reserves a zone without the transparent protective layer. The flexible antenna electrically couples to the electrical substrate of the wireless communication device via a flexible metal pin made of beryllium copper.

The flexible antenna apparatus of the present invention includes a metal layer. On the back surface of the metal layer there is an adhesive layer and, there is a transparent protective layer on another side of the metal layer. So, it can be directly pasted on the housing of the wireless communication device.

The flexible antenna apparatus of the present invention includes a metal layer that reserves a zone without the transparent protective layer, an adhesive layer located on the first surface of the metal layer, a transparent protective layer located on the second side of the metal layer, and a holder having a plastic pin and the zone without the transparent protective layer of the metal layer is pasted onto the plastic pin for electrically coupling to the electrical substrate of the wireless communication device.

The flexible antenna apparatus of the present invention includes a metal layer that reserves a zone without the transparent protective layer, an adhesive layer located on the first surface of the metal layer, a transparent protective layer located on the second side of the metal layer, and a pin connecting to the zone without the transparent protective layer of the metal layer for electrically coupling to the electrical substrate of the wireless communication device.

The manufacturing method for the flexible antenna apparatus of the present invention includes providing an adhesive layer, pasting a metal layer onto the adhesive layer, cutting the shape of the flexible antenna and producing a plurality of positioning holes by utilizing a steel mold, pasting a transparent protective layer onto the metal layer and cutting the outline of the flexible antenna and forming a zone without the transparent protective layer by utilizing the steel mold.

The manufacturing method for the flexible antenna apparatus of the present invention includes providing an adhesive layer, pasting a metal layer onto the adhesive layer, cutting the shape of the flexible antenna and creating a plurality of positioning holes by utilizing a steel mold, pasting a protective layer onto the metal layer and cutting the outline of the flexible antenna and forming a zone without the transparent protective layer by utilizing the steel mold, producing a holder that has a plastic pin (the strength of the plastic pin has been weakened by a procedure so that the plastic pin is flexible) and pasting the flexible antenna onto the holder and forming a zone without the transparent protective layer located on the plastic pin of the holder.

The manufacturing method for a flexible antenna apparatus of the present invention includes providing an adhesive layer, pasting a metal layer onto the adhesive layer, cutting the shape of the flexible antenna and a plurality of positioning holes by utilizing a steel mold, pasting a protective layer onto the metal layer and cutting the outline of the flexible antenna and forming a zone without the transparent protective layer by utilizing the steel mold, pasting the flexible antenna apparatus onto the housing of a wireless communication device, and producing a pin and fixing the pin with a positioning hole of the zone without the transparent protective layer by a melting method.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
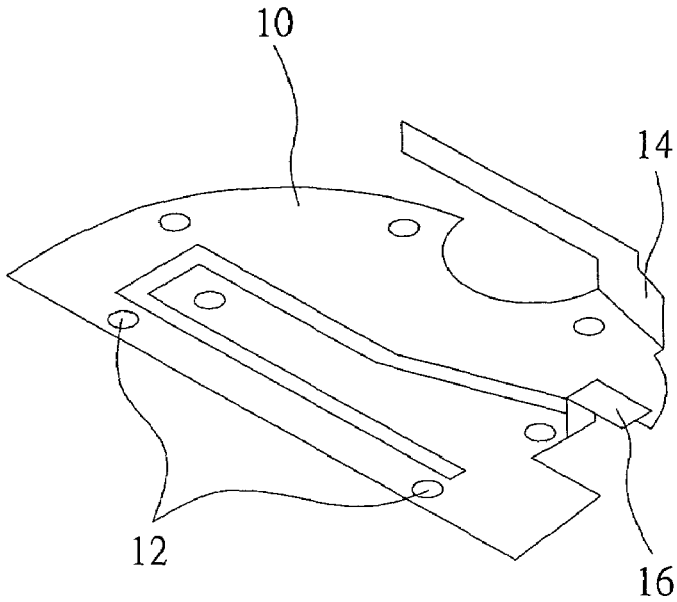
FIG. 1 PRIOR ART
FIG. 1 is a schematic diagram of a built-in antenna of the prior art.
Figure 2:
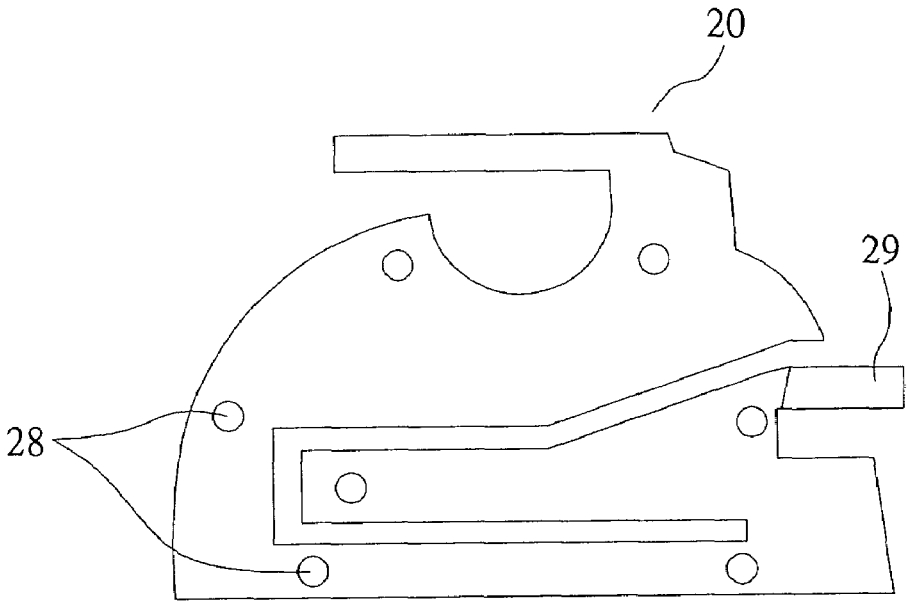
FIG. 2 is a schematic diagram of the first embodiment of a flexible antenna apparatus of the present invention.
Figure 3:
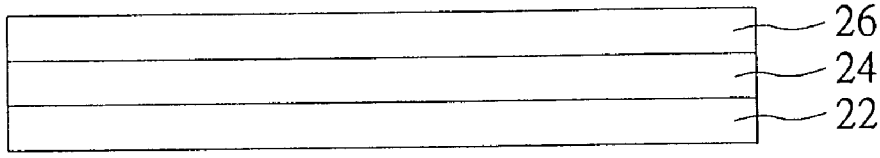
FIG. 3 is a schematic diagram of the structure of a flexible antenna apparatus of the present invention.

FIG. 2 shows a schematic diagram of the first embodiment of a flexible antenna apparatus of the present invention. FIG. 3 shows a schematic diagram of the structure of a flexible antenna apparatus of the present invention. The flexible antenna apparatus 20 includes a metal layer 24, an adhesive layer 22 and a transparent protective layer 26. The adhesive layer 22 is located on the first surface of the metal layer 24 and the transparent protective layer 26 is located on the second surface of the metal layer 24 to form a flexible structure with three layers. The metal layer 24 is a foil made of aluminum or other metal materials. The transparent protective layer 26 protects the metal layer and is easily manufactured.

The flexible antenna apparatus 20 further includes a plurality of positioning holes 28. The positioning holes 28 are provided to make pasting the flexible antenna apparatus 20 onto the housing of a wireless communication device (such as Bluetooth, mobile phone etc.) more convenient. The metal layer 24 has a zone without the transparent protective layer 29. The zone without the transparent protective layer 29 contacts the electrical substrate of the wireless communication device via the support part on the housing of the wireless communication device for receiving the signals.

The manufacturing method for the flexible antenna apparatus 20 of the present invention includes providing an adhesive layer 22, pasting a metal layer 24 onto the adhesive layer 22, cutting out the shape of the flexible antenna apparatus 20 and a plurality of positioning holes 28 by utilizing a steel mold, pasting a transparent protective layer 26 onto the metal layer 24 and cutting the outline of the flexible antenna apparatus 20 and forming a zone without the transparent protective layer 29 by utilizing the steel mold. After the flexible antenna apparatus 20 has been finished, the flexible antenna apparatus 20 is pasted onto the housing of the wireless communication device.

Figure 4:
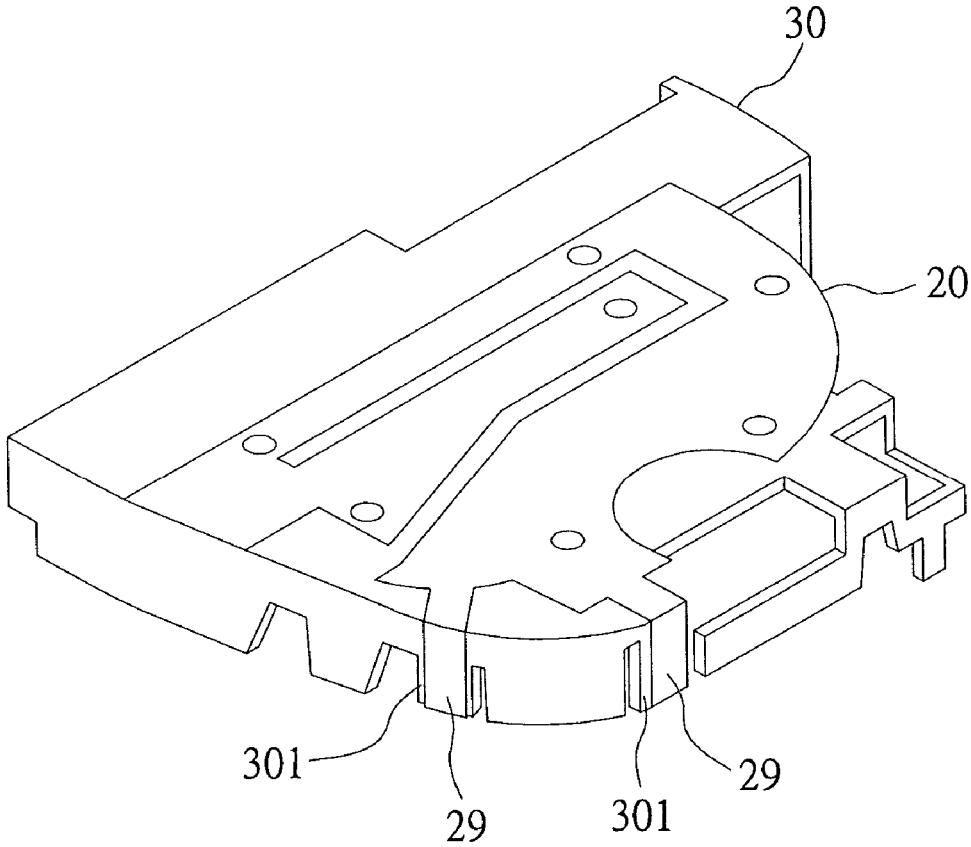
FIG. 4 is a schematic diagram of the second embodiment of a flexible antenna apparatus of the present invention.
Figure 4A:
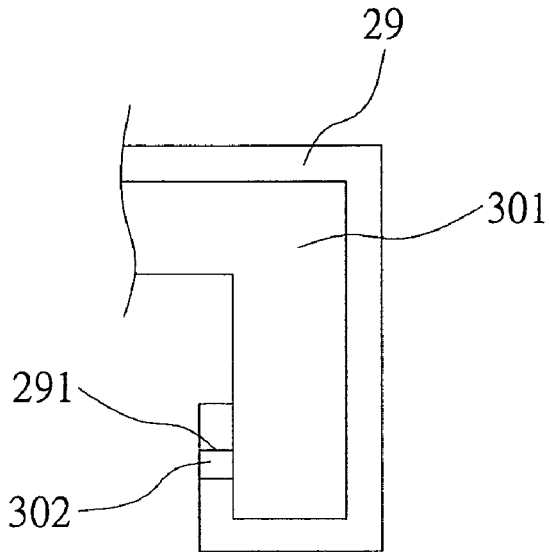
FIG. 4A is a more detailed schematic diagram of the more-detailed structure of the second embodiment of a flexible antenna apparatus of the present invention.

FIG. 4 shows a schematic diagram of the second embodiment of a flexible antenna apparatus of the present invention. The flexible antenna apparatus 20 includes a metal layer 24, an adhesive layer 22, a transparent protective layer 26 and a holder 30. The metal layer 24 has a zone without the transparent protective layer 29. The adhesive layer 22 is located on the first surface of the metal layer 24 and the transparent protective layer 26 is located on the second surface of the metal layer 24 to form a flexible structure with three layers. The metal layer 24 is a foil made of aluminum or other metal materials. The transparent protective layer 26 protects the metal layer and is easily manufactured.

The holder has at least one plastic pin 301. The zone without the transparent protective layer 29 of the metal layer 24 is pasted onto the plastic pin 301 of the holder 30 for contacting the electrical substrate of the wireless communication device. The strength of the plastic pin 301 of the holder 30 has been weakened via a procedure. The plastic pin 301 is flexible and springs back when an external force acts upon it. As such, the flexible antenna apparatus 20 can be securely electrically coupled to the electrical substrate of the wireless communication device. As shown in FIG. 4, there is a melting tip 302 located at the backside of the end of the plastic pin 301 of the holder 30. A melting opening 291 is located at the end of the zone without the transparent protective layer 29 of the metal layer 24 and is fixed and aligned with the melting tip 302 to prevent the flexible antenna apparatus 20 separating from the holder 30. The flexible antenna apparatus 20 further includes a plurality of positioning holes 28. The positioning holes 28 provide the positioning function with positioning points for the housing of a wireless communication device when the flexible antenna apparatus 20 is pasted onto the housing of a wireless communication device.

The manufacturing method for the flexible antenna apparatus 20 of the present invention includes providing an adhesive layer 22, pasting a metal layer 24 onto the adhesive layer 22, cutting the shape of the flexible antenna apparatus 20 and a plurality of positioning holes 28 by utilizing a steel mold, pasting a protective layer 26 onto the metal layer 24 and cutting the outline of the flexible antenna apparatus 20 and forming a zone without the transparent protective layer 29 by utilizing the steel mold, producing a holder 30 that it has a plastic pin 301 (the strength of the plastic pin 301 has been weakened via a procedure so that the plastic pin 301 is flexible), and forming a melting tip 302 on the plastic pin 301 of the holder 30 so that the positioning hole 291 of the flexible antenna apparatus 20 can fix with the melting tip 302 by a melting method, and pasting the flexible antenna apparatus 20 onto the holder 30 and a zone without the transparent protective layer 29 located on the plastic pin 301 of the holder 30. Therefore, the flexible antenna apparatus 20 electrically couples to the electrical substrate of the wireless communication device well due to the support provided by the plastic pin 301 of the folder 30.

Figure 5:
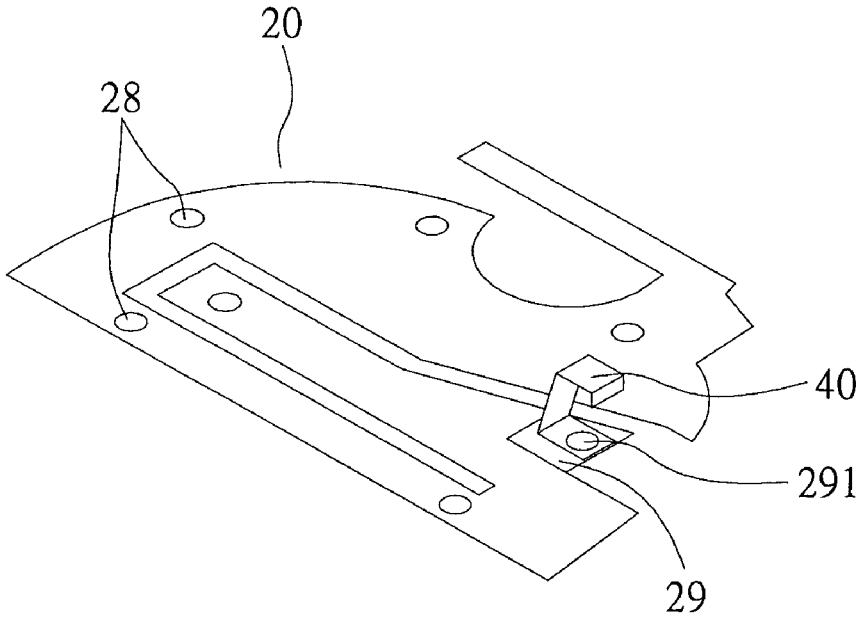
FIG. 5 is a schematic diagram of the third embodiment of a flexible antenna apparatus of the present invention.

FIG. 5 shows a schematic diagram of the third embodiment of a flexible antenna apparatus of the present invention. The flexible antenna apparatus 20 includes a metal layer 24, an adhesive layer 22, a transparent protective layer 26 and a pin 40. The metal layer 24 has a zone without the transparent protective layer 29. The adhesive layer 22 is located on the first surface of the metal layer 24 and the transparent protective layer 26 is located on the second surface of the metal layer 24 to form a flexible structure with three layers. The pin 40 connects to the zone without the transparent protective layer 29 of the metal layer 24 for electrically contacting to the electrical substrate of the wireless communication device. The pin 40 is made of beryllium copper or other metal materials. The metal layer 24 is a foil made of aluminum or other metal materials. The transparent protective layer 26 protects the metal and is easily manufactured.

The pin 40 and a positioning hole 291 of the flexible antenna apparatus 20 are fixed to the housing of the wireless communication device, so that the other end of the pin 40 can electrically couple to the electrical substrate of the wireless communication device. The flexible antenna apparatus 20 further includes a plurality of positioning holes 28. The positioning holes 28 provide a positioning function with the position points of the housing of a wireless communication device when the flexible antenna apparatus 20 is pasted onto the housing of a wireless communication device.

The manufacturing method for the flexible antenna apparatus 20 of the present invention includes providing an adhesive layer 22, pasting a metal layer 24 onto the adhesive layer 22, cutting the shape of the flexible antenna apparatus 20 and a plurality of positioning holes 28 by utilizing a steel mold, pasting a protective layer 26 onto the metal layer 24 and cutting the outline of the flexible antenna apparatus 20 and forming a zone without the transparent protective layer 29 by utilizing the steel mold, pasting the flexible antenna apparatus 20 onto the housing of a wireless communication device, and producing a pin 40 and fixing the pin 40 with a positioning hole 291 of the zone without the transparent protective layer 29 on the housing of the wireless communication device by a melting method.

The present invention has the following characteristics:

1. The flexible antenna apparatus of the present invention doesn't require a mold. As such, the time needed for modifying the mold to fit with the housing of the wireless communication device is saved. It shortens the time needed for the design stage so that the device can be launched earlier.

2. The present invention eliminates the cost of developing the mold and thereby reduces the cost of the antenna. As such, the present invention makes the cost of the antenna more competitive.

3. The raw materials are suitable for all models of wireless communication devices. Therefore, it reduces the amount of material that is wasted.

4. The flexible antenna apparatus of the present invention can be smoothly pasted onto the housing of wireless communication devices and has excellent reception. The manufacturing process is also simple.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A flexible antenna apparatus, comprising:

a metal layer;

an adhesive layer, located on a first surface of the metal layer; and a transparent protective layer, located on a second surface of the metal layer;

wherein the metal layer has a zone without the transparent protective layer for contacting the electrical substrate of a wireless communication device.

2. The flexible antenna apparatus of claim 1, wherein the metal layer is an aluminum foil layer.

3. The flexible antenna apparatus of claim 1, further comprising a plurality of positioning holes.

4. A flexible antenna apparatus, comprising:

a metal layer, having a zone without the transparent protective layer;

an adhesive layer, located on a first surface of the metal layer;

a transparent protective layer, located on a second surface of the metal layer; and a holder, having at least one plastic pin, the zone without the transparent protective layer of the metal layer is pasted onto the plastic pin of the holder for contacting the electrical substrate of a wireless communication device.

5. The flexible antenna apparatus of claim 4, wherein the metal layer is an aluminum foil layer.

6. The flexible antenna apparatus of claim 4, further comprising a plurality of positioning holes.

7. The flexible antenna apparatus of claim 4, wherein the plastic pin of the holder is weakened by a process and the plastic pin is flexible so that it springs back when an external forces acts upon it.

8. The flexible antenna apparatus of claim 4, wherein a melting tip is located at the backside of the end of the plastic pin of the holder and a melting opening is located at the end of the zone without the transparent protective layer of the metal layer, and the melting opening is fixed and aligned with the melting tip to prevent the flexible antenna apparatus from separating from the holder.

9. A flexible antenna apparatus, comprising:

a metal layer, having a zone without the transparent protective layer;

an adhesive layer, located on a first surface of the metal layer;

a transparent protective layer, located on a second surface of the metal layer; and a pin, connected to the zone without the transparent protective layer of the metal layer, for contacting the electrical substrate of a wireless communication device.

10. The flexible antenna apparatus of claim 9, wherein the metal layer is an aluminum foil layer.

11. The flexible antenna apparatus of claim 9, further comprising a plurality of positioning holes.

12. The flexible antenna apparatus of claim 9, wherein the pin fixes to a positioning hole of the flexible antenna apparatus by a melting method.

13. The flexible antenna apparatus of claim 9, wherein the pin is made of beryllium copper.

* * * * *